United States Patent [19]

Appleton

[11] 4,279,577

[45] Jul. 21, 1981

[54] ALTERNATING PISTON ROTARY ENGINE WITH LATCHING CONTROL MECHANISM AND LOST MOTION CONNECTION

[76] Inventor: John M. Appleton, 1032 Langland Ave., Muskegon, Mich. 49442

[21] Appl. No.: 64,178

[22] Filed: Aug. 6, 1979

[51] Int. Cl.[3] ..... F01C 1/00; F02B 53/00

[52] U.S. Cl. ..... 418/35

[58] Field of Search ..... 418/35; 123/245

[56] References Cited

U.S. PATENT DOCUMENTS

| | | | |
|---|---|---|---|
| 932,321 | 8/1909 | Plates | 418/35 |
| 1,212,649 | 1/1917 | Krikorian | 418/35 |
| 1,739,104 | 12/1929 | Tropp | 418/35 |
| 2,088,779 | 8/1937 | English | 418/35 |
| 3,136,303 | 6/1964 | Ievins | 418/35 |
| 3,227,090 | 1/1966 | Bartolozzi | 418/35 |
| 3,340,815 | 9/1967 | Sinnott | 418/35 |

FOREIGN PATENT DOCUMENTS

| | | | |
|---|---|---|---|
| 1094785 | 12/1954 | France | 418/35 |

*Primary Examiner*—John J. Vrablik

*Attorney, Agent, or Firm*—Lowe, Kokjer, Kircher, Wharton & Bowman

[57] ABSTRACT

This invention deals with an improved rotary engine of the rotating abutment type and, more particularly, with a unique movement control mechanism which is suitable for use with such an engine. An engine of this type is equipped with two of these movement control mechanisms, each of which is arranged to control the operation of two of the engine's four pistons. In particular, each movement control mechanism is operable to periodically prevent rearward movement of its associated pistons for a predetermined interval and to limit forward movement of these pistons to a set distance during said predetermined interval. Each movement control mechanism is also operable to periodically couple its associated pistons to the engine's central shaft to thereby transfer rotary motion to and receive rotary motion from the central shaft at regular and predetermined intervals.

6 Claims, 6 Drawing Figures

ALTERNATING PISTON ROTARY ENGINE WITH LATCHING CONTROL MECHANISM AND LOST MOTION CONNECTION

BACKGROUND AND BRIEF DESCRIPTION OF THE INVENTION

This invention relates in general to internal combustion engines and, in particular, to an improved internal combustion engine of the rotary type.

In an effort to eliminate many of the engineering problems associated with reciprocating, piston-type internal combustion engines, a considerable amount of research and design work has recently been directed toward development of a rotary type of engine. This effort has led to the development of three different types of rotary engines, including: (1) rotary engines having a three-lobed rotor for movement around a three-lobed chamber; (2) rotary engines having special rotating abutments; and (3) rotary engines with special sliding abutments.

This invention deals primarily with a rotary engine of the rotating abutment type. This type of engine typically includes an outer housing which is comprised of a cylindrically-shaped outer wall and a pair of end walls. One end wall is attached to each end of the cylindrically-shaped outer wall to provide an annular chamber within the housing. In addition, the end walls are typically arranged to support a drive shaft which is positioned to extend through the axial center of the annular chamber defined within the outer housing. A conventional spark plug is normally mounted in the circular outer wall of the housing such that it communicates with the annular chamber. An inlet port is provided in the outer housing to introduce a mixture of air and fuel into the annular chamber, and an outlet port is provided to release exhaust products therefrom.

Engines of the above-mentioned type also include a pair of piston-forming pieces which are typically mounted onto the drive shaft adjacent to each other. Each of the piston-forming pieces is normally constructed to have a central hub and a pair of oppositely disposed pistons which extend radially outward from the central hub. The piston-forming pieces are positioned on the drive shaft such that the pistons of these pieces are alternately situated within the annular chamber and such that the pistons of each piece overlap the hub portion of the adjacent piece and extend from one end wall of the inner chamber to the other. In this way, the pistons cooperate with the cylindrically-shaped housing and opposing side walls to define four separate chambers.

In operation, the piston-forming pieces interact to simulate the characteristics of an otto cycle, i.e., intake, compression, combustion and exhaust. A detailed description of the operation of this type of rotary engine is given in U.S. Pat. No. 2,088,779, which was issued to C. C. English on Aug. 3, 1937, and in U.S. Pat. No. 3,136,030, which was issued to A. E. Ievins on June 9, 1964. Both of these patents are herein incorporated by reference.

A brief description of the operation of this type of engine, however, will be undertaken at this time to provide a better basis for understanding the significance of the present invention. The combustion cycle is started when an explosive mixture of air and gas is compressed between two adjacent pistons in proximity to the spark plug. At this time, one of the pistons is locked in a stationary position and is designated the abutting piston. The other piston is designated the driving piston and is in turn temporarily coupled with the drive shaft.

The spark plug is then fired, causing the mixture of air and gas which is compressed between the abutting and driving pistons to be ignited. The explosive force thus produced causes the driving piston to be driven away from the abutting piston in a forward direction. Since the driving piston is now coupled with the drive shaft, rotary movement of this piston is in turn imparted to the drive shaft. Movement of the drive piston also causes the exhaust products from a previous firing to be driven out of the annular chamber through the outlet port.

The piston-forming piece of which the driving piston is a component carries an opposing piston which extends radially outward from the central hub portion of this piece in a direction which is diametrically opposite to that of the drive piston. Accordingly, both of these pistons move through the annular chamber in unison. As the opposing piston moves through the chamber, it draws air and gas into the inner chamber of the engine through the inlet port. Movement of this piston toward the abutting piston also causes the mixtue of air and gas located between these two pistons to become compressed. Further movement of the opposing piston twoard the abutting piston causes the abutting piston to be moved into position to become the driving piston for the next power stroke. To properly position the abutting piston for use as the driving piston during the next power stroke, forward movement of this piston is restricted to a set distance until just prior to firing of the spark plug initiating the next power stroke.

During the latter part of the first power stroke when the opposing piston is moving the abutting piston in position to be the driving piston for the second power stroke, the piston-forming piece carrying the opposing piston becomes coupled with the drive shaft so as to receive rotary motion therefrom. Once the opposing piston assumes the position previously occupied by the abutting piston, the piston-forming piece associated with the opposing piston is disconnected from the drive shaft and the opposing piston is locked in a stationary position to form the abutting piston for the next power stroke. Thereafter, the forward restriction on the new driving piston is removed, the piston-forming piece carrying the new driving piston is coupled with the drive shaft, and the spark plug is fired to initiate the next power stroke.

Accordingly, every rotary engine of the rotating abutment type must be operable to perform several basic functions. In particular, the engine must be able to control the movement of the rotating pistons to periodically form a combustion chamber about the spark plug. In order to do this, the engine must be operable to hold the abutting piston of the chamber in a stationary position when the spark plug is fired and to restrict forward movement of the driving piston until just before firing of the spark plug. The engine must also be operable to couple the driving piston to the drive shaft upon firing of the spark plug to thereby transfer to the drive shaft the rotary motion imparted to the driving piston upon firing of the spark plug. Finally, the engine must be operable to couple the drive shaft to the piston-forming piece carrying the driving piston during the latter part of the power stroke to thereby transfer rotary motion to the piston-forming piece.

These basic functions are normally regulated by a pair of movement control mechanisms which are incorporated into the engine. An example of such a movement control mechanism is given and described in U.S. Pat. No. 2,088,779, which was issued to C. C. English on August 3, 1937. Another technique for controlling these functions is given and described in U.S. Pat. No. 3,136,303, which was issued to A. E. Ievins on June 9, 1964. As mentioned above, both of these patents are incorporated by reference herein.

These prior art control mechanisms, however, are fairly complex in design and operation. As a result, the presently known rotary engines are costly to manufacture and maintain and are unreliable at higher speeds.

It is therefore an object of the present invention to provide an improved rotary engine of the rotating abutment type which is simple in design and operation.

Another object of the present invention is to provide an improved rotary engine of the rotating abutment type which is simple and economical to construct and operate.

An additional object of the present invention is to provide an improved rotary engine of the rotating abutment type which operates in a reliable manner at both high and low speeds.

Another object of the present invention is to provide an improved rotary engine of the rotating abutment type which may be quickly and easily repaired.

It is a further object of the present invention to provide an improved rotary engine of the rotating abutment type which utilizes a unique movement control mechanism that greatly simplifies the design and operation of such an engine.

It is an additional object of the present invention to provide an improved rotary engine of the rotating abutment type which utilizes a unique movement control mechanism that reliably controls the movement of the engine's pistons at both high and low speeds.

Other and further objects of this invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are employed to indicate like parts in the various views.

Figure 1:
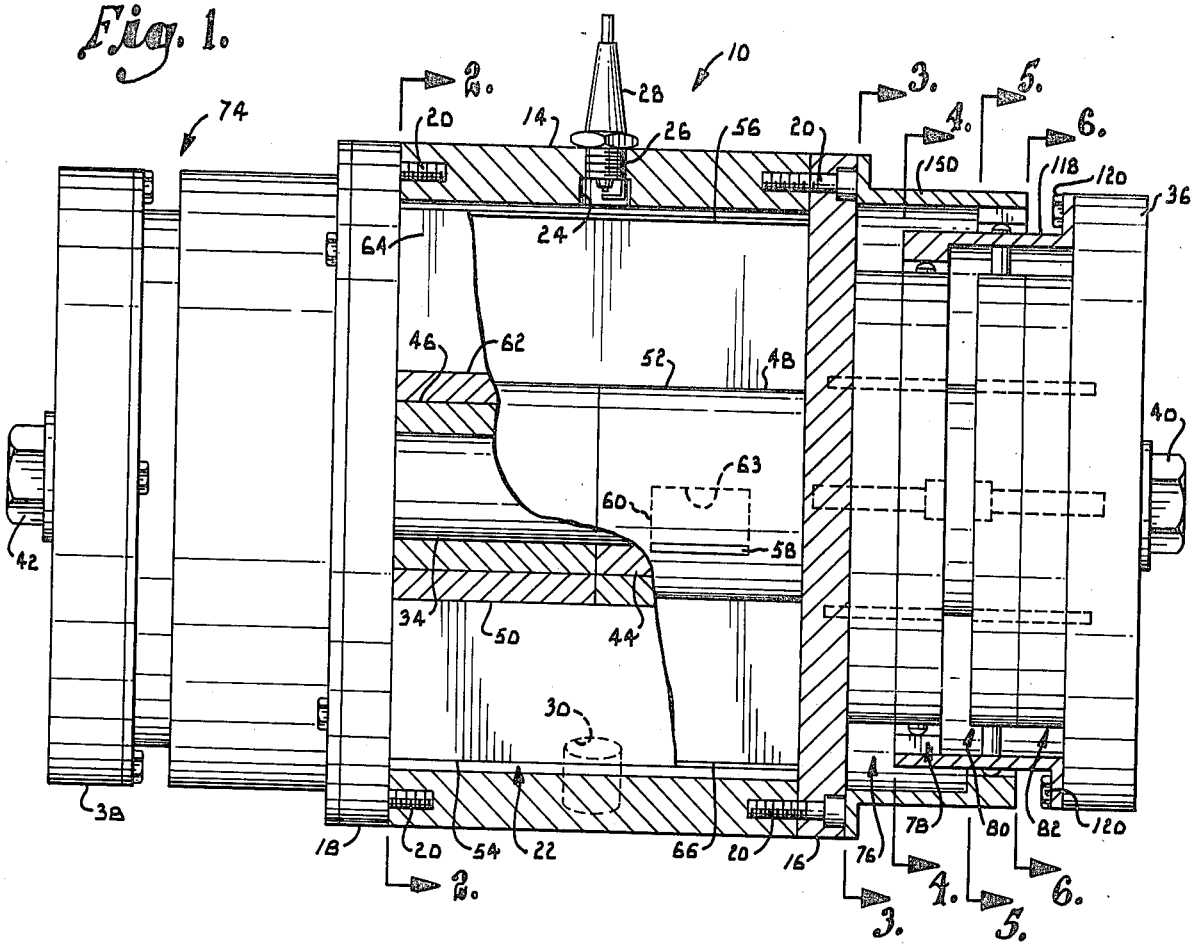
FIG. 1 is a front elevational view of a rotary engine constructed according to a preferred embodiment of the present invention, with portions broken away for the purposes of illustration.
Figure 2:
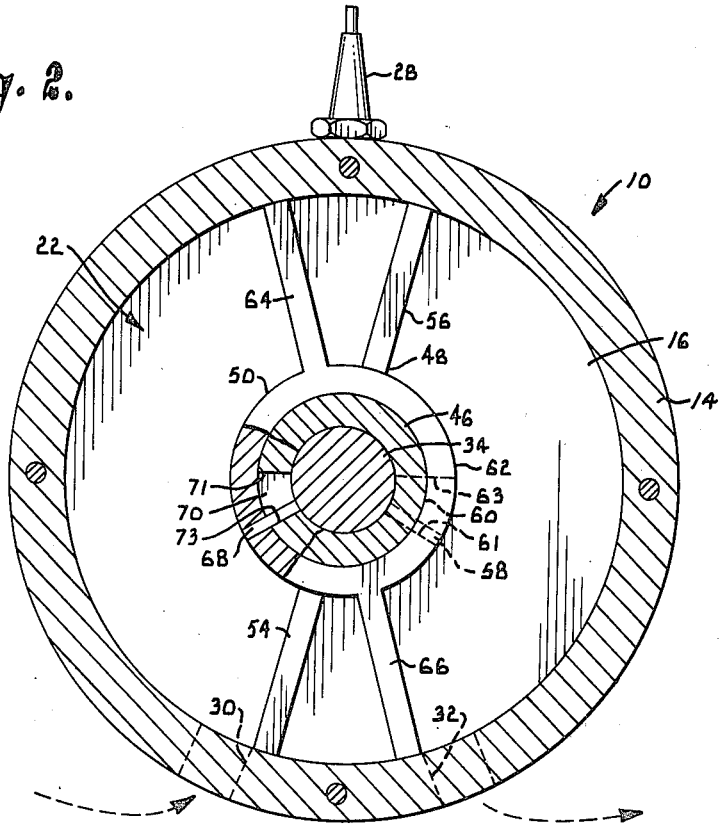
FIG. 2 is a cross sectional view taken generally along line 2—2 of FIG. 1 in the direction of the arrows with portions broken away for the purposes of illustration.

Reference is now made to the drawings in detail and initially to FIGS. 1 and 2 wherein the numeral 10 is used to designate a rotary engine which is constructed in accordance with a preferred embodiment of the present invention. The engine illustrated in these figures includes an outer casing which is comprised of an outer circular wall 14 and end walls 16 and 18. Each of the outer end walls is mounted to its corresponding end of the circular outer wall 14 by means of a plurality of mounting screws 20. In this way, the circular outer casing and end plates cooperate to define an annular chamber which is generally designated by the numeral 22.

A spark plug opening 24 is provided in outer circular wall 14. The upper portion of spark plug opening 24 is threaded at 26 to receive and hold a conventional spark plug 28. Spark plug 28 fits within opening 24 such that the electrodes of the plug communicate with annular chamber 22. An inlet port 30 and an outlet port 32 are also defined in the outer circular wall 14 of the casing.

A central shaft 34 is provided to properly align the operable components of the engine. This shaft in turn carries a pair of coupling pieces 44 and 46. Each coupling piece is comprised of a tubular piece of metal having a cylindrical outer surface and a hollow inner channel. The diameter of the inner channel in each coupling piece is slightly larger than the outer diameter of the central shaft to thereby allow for free movement of each piece on the shaft.

Coupling pieces 44 and 46 are positioned adjacent to each other on central shaft 34 such that they abut against each other at the center of annular chamber 22. Coupling pieces 44 and 46 extend outward from the center of annular chamber 22 in opposite directions. Central shaft 34 and coupling pieces 44 and 46 are positioned to extend through the axial center of annular chamber 22 and are allowed to pass through a circular opening (not shown herein) in each of the end walls 16 and 18 of the chamber. In particular, central shaft 34 and coupling piece 44 pass through a circular opening in end wall 16 while central shaft 34 and coupling piece 46 pass through an opening in end wall 18. A pair of fly wheels 36 and 38 are in turn attached to each end of central shaft 34 by means of mounting bolts 40 and 42, respectively. The flywheels and coupling pieces are spaced apart from each other and, as a result, rotate independently of each other.

A pair of piston-forming pieces 48 and 50 are respectively carried by coupling pieces 44 and 46 within the annular chamber 22 of the engine. Piston-forming piece 48 is constructed to have a central hub 52 and a pair of oppositely disposed pistons 54 and 56 which extend radially outward from the central hub of this piece. Central hub 52 is constructed to have a hollow inner channel which allows this piece to fit over its associated coupling piece 44 such that piston-forming piece 48 is free to move relative to coupling piece 44. Movement of piston-forming piece 48 relative to coupling piece 44, however, is limited by means of a keyed coupling between the piston-forming and the coupling pieces. This keyed coupling is accomplished by means of a key element 58 which interacts with an opening 60 in coupling piece 44. Key element 58 is attached to and extends radially inward from the central hub 52 of piston-forming piece 48. The key element 58 fits within opening 60 and is capable of traversing this opening to provide limited rotational movement of piston-forming piece 48 relative to coupling piece 44. Opening 60 is comprised of a rectangular slot which is arranged to have a forward wall 61 and a back wall 63.

Piston-forming piece 50 is likewise comprised of a central hub 62 and a pair of oppositely disposed pistons 64 and 66 which extend radially outward from the central hub of this piece. The central hub 62 of piston-forming piece 50 is also constructed to have a hollow inner channel with a diameter slightly larger than the outer diameter of its associated coupling piece 46 to thereby allow for free movement of the piston-forming piece relative to the coupling piece. Movement of piston-forming piece 50 relative to coupling piece 46 is likewise restricted by means of a key element 68 which interacts with an opening 70 in coupling piece 46. Key element 68 is attached to central hub 62 of piston-fomring piece 50 such that it is capable of moving back and forth within opening 70 to thereby provide limited rotational movement of piston-forming piece 50 relative to coupling piece 46. Opening 70 is comprised of a rectangular shaped slot which is arranged to have a forward wall 71 and a back wall 73. When the engine is fully assembled, the hub 52 of piston-forming piece 48 is positioned within inner chamber 22 adjacent to hub 62 of piston-forming piece 50. In this position, pistons 54 and 56 of piston-forming piece 48 protrude toward and overlap hub 62 of piston-forming piece 50 so as to extend from the inner surface of end wall 16 to the inner surface of end wall 18. Pistons 64 and 66 of piston-forming piece 50 likewise protrude toward and overlap hub portion 52 of piston-forming piece 48 so as to extend from the inner surface of end wall 18 to the inner surface of end wall 16. In this way, the pistons of both piston-forming pieces are alternately situated within the annular chamber and cooperate with the circular outer wall 12 and end walls 16 and 18 to form four separate chambers.

The movement of each piston-forming piece is regulated by a movement control mechanism. The movement control mechanism associated with piston-forming piece 48 is generally designated by the numeral 72, while the movement control mechanism associated with piston-forming piece 50 is designated by the numeral 74. Both of these movement control mechanisms are of the same basic construction. Since both of these mechanisms are similar in design and operation either mechanism can be used as the basis of a detailed explanation. As a result, only movement control mechanism 72 will be described in detail herein.

Movement control mechanism 72 is basically comprised of a plurality of latching mechanisms which are generally designated by the numerals 76, 78, 80 and 82. Latching mechanisms 76, 78, 80 and 82 cooperate with each other to control the operation of piston-forming piece 48. In particular, these mechanisms cooperate to couple piston-forming piece 48 with central shaft 34 at regular and timed intervals and to hold this piece in a stationary position at regular and timed intervals to thereby ensure the proper operation of the engine.

Figure 3:
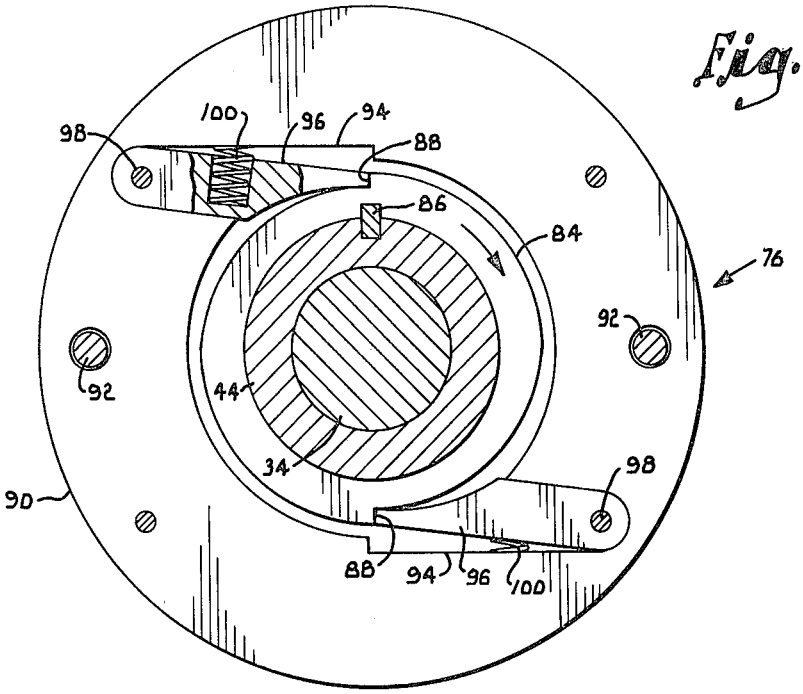
FIG. 3 is a cross sectional view taken generally along line 3—3 of FIG. 1 in the direction of the arrows.

Reference is now made to FIGS. 1 and 3 for a more detailed description of latching mechanism 76. This latching mechanism is comprised of a ratchet piece 84 which is keyed by means of a key element 86 to coupling piece 44 for movement in combination therewith. Ratchet piece 84 is constructed to have a pair of abutting teeth 88 which are positioned at diametrically opposite points of the rachet piece. The outer contour of ratchet piece 84 is arranged to provide a smooth transition from the inner edge of one tooth to the outer edge of the other tooth.

Ratchet piece 84 is encircled by a stationary support ring 90. Support ring 90 is mounted to the outer surface of side wall 16 by means of mounting screws 92. The stationary support ring 90 is provided with a pair of recesses 94 which communicate with the interior area of the ring at diametrically opposite points thereof. Each recess 94 is arranged to receive a pawl 96 which is mounted within its associated recess by means of a pivot pin 98 such that the pawl is capable of pivoting between a first position wherein it is contained completely within its corresponding recess and a second position wherein it projects outward of its recesses into engagement with the abutting teeth 88 of ratchet piece 84. A pair of springs 100 are provided to releasably maintain pawls 96 in the second position.

Figure 4:
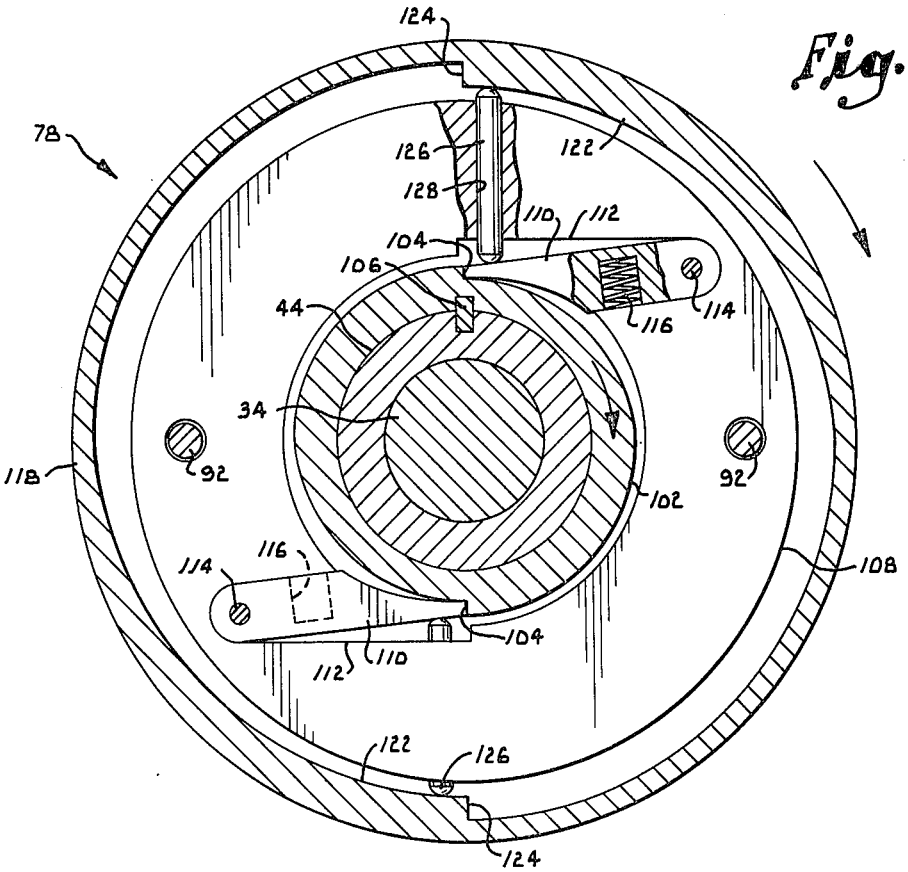
FIG. 4 is a cross sectional view taken generally along line 4—4 of FIG. 1 in the direction of the arrows.

Referring now to FIGS. 1 and 4, latching mechanism 78 is basically comprised of a circular ratchet piece 102 having a pair of abutting teeth 104 defined therein at diametrically opposite points thereof. Ratchet piece 102 is keyed to coupling piece 44 by means of a key element 106. In this way, ratchet piece 102 and coupling piece 44 are locked together to move in unison. Ratchet piece 102 is constructed to have an outer contour which provides a smooth transition from the outer edge of one tooth to the inner edge of the other tooth.

Latching mechanism 78 is also comprised of a stationary support ring which is designated by the numeral 108. Support ring 108 is mounted to end wall 16 adjacent to support ring 90 by means of mounting screws 92. The support ring is arranged to carry a pair of pawls 110 within a pair of recesses 112. Recesses 112 are arranged to open into the inner periphery of ring 108 at diametrically opposite points thereof. Each pawl 110 is mounted within its associated recess 112 by means of a pivot pin 114. In this way, each pawl is capable of pivotally moving between a first position wherein it is contained within its associated recess and a second position wherein it projects outward of its recess into the path of movement of the abutting teeth 104 on ratchet piece 114. Each pawl is also provided with an associated spring such as 116 which is arranged to urge its corresponding pawl into its associated recess.

Support ring 108 is in turn encircled by a camming ring 118 which is attached to fly wheel 38 by means of a plurality of mounting screws 120. As shown in FIG. 4, camming ring 118 is constructed to have a pair of inclined camming surfaces 122 each of which extends along one quarter of the inner circumference of the ring and terminate in steps 124.

A pair of positioning pins 126 are provided to regulate the position of the pawls 110 carried by support ring 108 in response to the profile of camming ring 118. The positioning pins 126 are carried by the stationary support ring 108 within an associated mounting channel such as 128. Each pin is positioned within its associated channel for free movement therein. One end of each pin rides along the inner surface of the camming ring while the other end of the pin rests against the back surface of its corresponding pawl.

Figure 5:
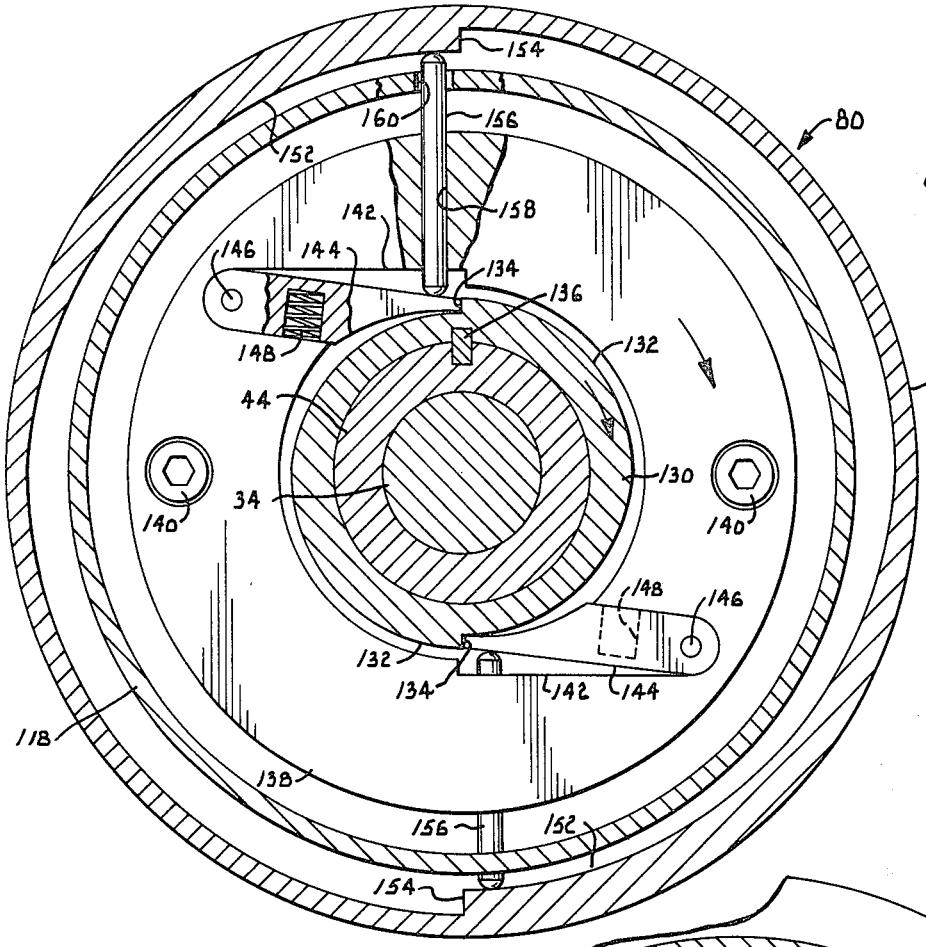
FIG. 5 is a cross sectional view taken generally along 5—5 of FIG. 1 in the direction of the arrows.

Reference is now made to FIGS. 1 and 5 for a more detailed description of latching mechanism 80. Latching mechanism 80 is basically comprised of a circular ratchet piece 130 which is constructed to have two tapered inclined profiles 132 which terminate in abutting teeth 134. Ratchet piece 130 is keyed to coupling piece 44 by means of a key element 136.

Latching mechanism 80 also includes a rotating support ring 138 which is coupled with fly wheel 38 by means of a plurality of mounting screws 140. Support ring 138 is also provided with a pair of recesses 142 which are arranged to open into the inner periphery of the ring at diametrically opposite points thereof. A pawl 144 is in turn pivotally mounted within each recess 142 by means of a pivot pin 146. Each pawl is mounted within its associated recess such that it is capable of being pivotally moved between a first position wherein it is contained within its associated recess and a second position wherein it is projecting out of its recess into the path of the abutting teeth 134 of ratchet piece 130. Each pawl is biased into its associated recess by means of a coil spring such as 148.

Support ring 138 is encircled by camming ring 118 and by a second camming ring 150. Camming ring 150 is fixedly secured to end wall 16 of the outer housing and remains in a stationary position at all times. As shown in FIG. 5, the thickness of camming ring 150 is varied to provide a pair of inclined camming surfaces 152, each of which extends along one quarter of the inner circumference of the ring and terminates in steps 154. The position of each of the pawls 144 carried by support ring 138 is regulated by means of a control pin 156 in accordance with the inner profile of camming ring 150. Each of these pins sits within a corresponding channel 158 in support ring 118. Each of the positioning pins 156 is positioned within its associated channel for free movement therein. As shown in this figure, one end of each positioning pin 156 rests against the back surface of its corresponding pawl while the other end of the pin rides along the inner surface of camming ring 150. Camming ring 118 is equipped with a pair of openings such as 160 which allow the positioning pins 156 to pass through this ring unimpeded.

Figure 6:
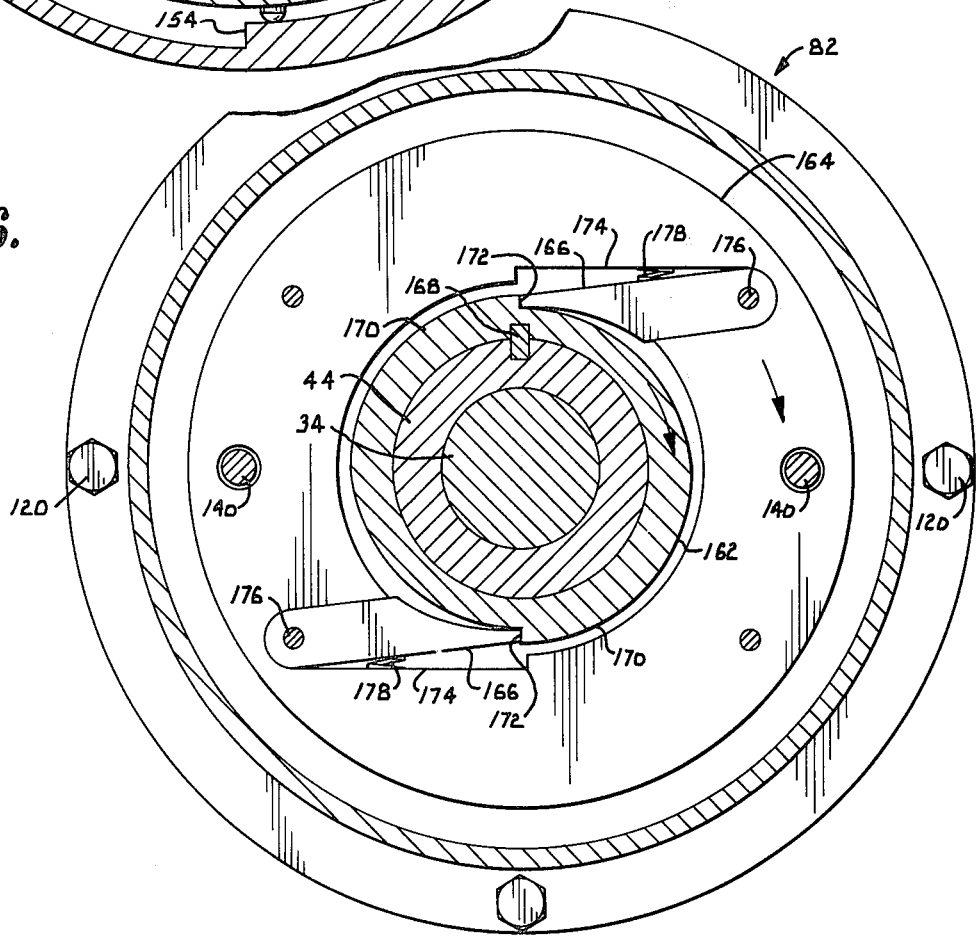
FIG. 6 is a cross sectional view taken generally along line 6—6 of FIG. 1 in the direction of the arrows.

Referring now to FIGS. 1 and 6, latching mechanism 82 includes a ratchet piece 162, a movable support ring 164 and a pair of pawls 166. Ratchet piece 162 is carried by coupling piece 44 and is keyed to this piece by means of a key element 168. The ratchet piece 162 is constructed to have a pair of tapered inclined profiles which are generally designated by the numeral 170. These profiles terminate in abutting teeth 172. Ratchet piece 162 is constructed to have an outer contour which provides a smooth transition from the inner edge of one abutting tooth to the outer edge of the other abutting tooth.

The movable support ring 164 is mounted onto the fly wheel for movement in combination therewith by means of mounting screws 140. The support ring 164 is also provided with a pair of recesses which are generally designated by the numeral 174. Each of the recesses 174 opens into the interior area of support ring 164 and is arranged to receive one of the pawls 166 carried by the support ring. Each of the pawls 166 is mounted within its associated recess by means of a pivot pin 176. Both of the pawls are capable of pivotally moving between a first position wherein they are contained within their associated recesses and a second position wherein they project outward from their recesses into the path of the abutting teeth 172 of ratchet piece 162. These pawls are biased into the latter position by means of a pair of coil springs 178.

In operation, each piston-forming piece is aternately coupled with the central shaft to provide impulses thereto. To accomplish this drive action, each piston-forming piece is periodically coupled to the central shaft for a predetermined time interval which is regulated by its associated movement control mechanism. As described above, both of the movement control mechanisms are identical in design and operation.

FIGS. 1–6 show the operable components of the engine in their respective positions just prior to ignition of spark plug 28. As shown in FIG. 2, pistons 56 and 64 are positioned adjacent to each other to form a combustion chamber about spark plug 28. At this time, piston-forming piece 50 is securely locked in a stationary position by means of its control mechanism 74. As a result, piston 64 of this piece constitutes the abutting wall of the combustion chamber.

Forward or clockwise movement of piston 56 is also restricted at this time by means of latching mechanism 78 which is particularly shown in FIG. 4. As shown in this figure, the positioning pins 126 carried by support ring 108 are being forced inward at this time by means of the camming surfaces 112 of camming ring 118. With the positioning pins in this position, pawls 110 are brought into engagement with the abutting teeth 104 of ratchet piece 102 to thereby prevent clockwise movement of the ratchet piece. Since ratchet piece 102 is keyed to coupling piece 44, clockwise rotation of the coupling piece is likewise prohibited. In addition, piston-forming piece 48 has now moved as far in a clockwise direction relative to coupling piece 44 as key element 58 and opening 60 will allow. As shown in FIGS. 1 and 2, key element 58 is now resting against the forward wall 61 of opening 60 to thereby prevent the piston-forming piece from any further clockwise movement relative to the coupling piece. Since clockwise movement of coupling piece 44 is inhibited by latching mechanism 78 and since further forward movement of piston-forming piece 48 relative to coupling piece 44 is prohibited by key element 58, clockwise movement of piston-forming piece 48 is inhibited and the forward position of piston 56 is thereby maintained.

As camming ring 118 continues to rotate in combination with fly wheel 38, the terminating steps 124 of the camming surfaces 112 move past the positioning pins 126. Once terminating steps 124 pass positioning pins 126, the biasing force imparted to pawls 110 by means of their associated coil springs causes the pawls and their associated pins to move radially outward from the interior of support ring 108. When this occurs, the pawls 110 carried by support ring 108 move out of engagement with the abutting teeth 104 of ratchet piece 102 thereby permitting rachet piece 102 to move in a clockwise direction.

Thereafter, the power stroke is initiated by causing spark plug 28 to be fired. Firing of the spark plug in turn causes the mixture of air and gas which is compressed between pistons 56 and 64 to be exploded. The explosive force thus produced causes piston 56 to be driven in a clockwise or forward direction. This rotary movement of piston 56 is in turn imparted to central shaft 34 via coupling piece 44 and latching mechanism 82. In particular, key element 58 of piston-forming piece 48 pushes against the forward wall 61 of opening 60 to thereby cause coupling piece 44 to move in combination with the piston-forming piece. The rotary motion thus imparted to coupling piece 44 is in turn transferred to ratchet piece 162 because of the keyed connection between the coupling and ratchet pieces. As shown in FIG. 6, clockwise rotation of ratchet piece 162 causes its abutting teeth 172 to come in contact with the pawls 166 carried by support ring 164 to thereby transfer rotational motion from the ratchet piece to the support ring. Support ring 164 is in turn coupled with fly wheel 36 so that the rotational motion imparted to the piece is also transferred to the fly wheel.

As piston 56 rotates in a clockwise direction, it causes the exhaust products from the previous power stroke to be driven out of the inner chamber through outlet port 32. In addition, the other piston 54 of piston-forming piece 48 moves in a clockwise direction in combination with piston 56 causing a mixture of fuel and air to be sucked into the inner chamber behind it through inlet port 30. Clockwise movement of piston 54 also causes the mixture of gas and air which is located between pistons 54 and 64 to be compressed to prepare it for the next power stroke.

As piston 54 approaches piston 64, piston 54 is at the end of the power stroke, and as a result, the driving force behind piston-forming piece 48 is relatively small. In addition, the compressive force of the air and gas mixture between pistons 54 and 64 becomes relatively large, producing a force which tends to resist further clockwise movement of piston 54. To ensure that piston 54 will move the required distance to form a combustion chamber about spark plug 28 for the next power stroke, piston-forming piece 48 is coupled with fly wheel 36 through latching mechanism 80 during the latter part of the power stroke. As shown in FIG. 5, the camming surfaces 152 of camming ring 150 engage positioning pins 156 during the latter part of the power stroke to thereby cause these pins to move their respective pawls 144 into engagement with the abutting teeth 134 of rachet piece 130. Upon engagement of the pawls and abutting teeth, the rotary movement of support ring 138 is imparted to rachet piece 130 to thereby cause this piece to rotate in a clockwise direction in unison with the support ring. Since rachet piece 130 is keyed to coupling piece 44, the rotary motion imparted to the rachet piece is simultaneously transferred to the coupling piece causing it also to rotate in a clockwise direction.

As coupling piece 44 begins to rotate in response to the rotary motion imparted to it from fly wheel 36, coupling piece 44 moves independently of piston-forming piece 48 causing key element 58 to traverse opening 60 in coupling piece 44. Once key element 58 reaches the back wall 63 of opening 60, further movement of coupling piece 44 causes piston-forming piece 48 to move in combination therewith.

As piston 54 approaches piston 64, the air and gas mixture which is contained between these two pistons becomes compressed, thereby producing a force which acts on piston 64 to move it in a clockwise direction. The extent of this clockwise movement is regulated by movement control mechanism 74. This mechanism operates to restrict the distance that piston 64 is allowed to move to thereby properly position this piston about spark plug 28.

Returning now to FIG. 5, the camming surface 152 of camming ring 150 is arranged to keep the pawls 144 carried by support ring 138 in contact with the abutting teeth 134 of ratchet piece 130 long enough to cause piston-forming piece 48 to move a distance sufficient to locate piston 54 in the position previously occupied by piston 64. As piston 54 reaches this position, positioning pins 156 move past the terminating steps 154 of camming surfaces 152, thereby allowing pawls 144 to pivot out of engagement with the abutting teeth 134 of ratchet piece 156. Upon disengagement of these pawls and abutting teeth, piston-forming piece 48 no longer moves in a clockwise direction.

Once piston 54 reaches the position previously occupied by piston 64, latching mechanism 76 acts to preclude counterclockwise movement of piston 54. As shown in FIG. 3, ratchet piece 84 is keyed to coupling piece 44 and moves in combination therewith. As piston 54 reaches the position previously occupied by piston 64, the abutting teeth 88 of ratchet piece 84 move past the pawls 96 carried by support ring 90, thereby allowing these pawls to drop in place behind the abutting teeth to prevent counterclockwise movement of the ratchet piece. Since ratchet piece 84 is keyed to coupling piece 44, coupling piece 44 is also prevented from moving in a counterclockwise direction. Counterclockwise movement of piston-forming piece 48 is also prevented because key element 58 is resting against the back wall 63 of opening 60 at this time. In this way, latching mechanism 76 operates to prevent piston 54 from moving in a counterclockwise or rearward direction to thereby provide the abutting wall of the combustion chamber for the next power stroke.

Once piston-forming piece 48 has been locked so as to preclude rearward movement thereof, spark plug 28 is fired a second time causing piston 64 to be driven in a forward or clockwise direction. This piston is coupled with the central shaft 34 through its control mechanism 74 to thereby provide an impulse to this shaft. As piston 64 moves in a clockwise direction, its opposing piston 66 moves in a clockwise direction toward piston 54. Movement of piston 66 toward piston 54 causes the air and gas mixture which is contained between these two pistons to become compressed. Further movement of piston 66 toward piston 54 causes piston 54 to begin moving in a clockwise direction. Just before piston 54 begins moving in a clockwise direction, however, latching mechanism 78 (shown in FIG. 4) is placed in condition to prevent forward movement of ratchet piece 102. In particular, the camming surfaces 122 of camming ring 118 act through positioning pins 126 to move pawls 110 into engagement with the abutting teeth 104 of ratchet piece 102. Engagement between pawls 110 and the abutting teeth 104 of ratchet piece 102 prevents ratchet piece 102 from moving in a clockwise direction. Since the ratchet piece 102 is keyed to coupling piece 44, coupling piece 44 is also prevented from moving in a clockwise direction. Even though coupling piece 44 is now precluded from moving in a clockwise direction by control mechanism 78, piston-forming piece 48 is capable of limited clockwise or forward movement due to the type of connection between the piston-forming piece and coupling piece 44. In particular, the piston-forming piece 48 is capable of moving in a forward or clockwise direction relative to coupling piece 44 until the key element 58 carried by the piston-forming piece comes in contact with the front wall 61 of the opening 60 in the coupling piece 44. The distance that piston 54 is capable of moving is determined by the length dimension of opening 60. Opening 60 in turn is constructed to have a length sufficent to allow piston 54 to be moved into position to become the driving piston for the next combustion stroke. Just before spark plug 28 is fired to initiate the next power stroke, latching mechanism 78 releases ratchet piece 102 as described above, thereby allowing piston 54 to move in a forward or clockwise direction upon firing of spark plug 28. In this way, latching mechanism 78 operates in combination with coupling piece 44 to properly position the drive piston and to hold this piston in place until just before spark plug 28 is fired.

The above-described cycle of operation is then repeated using piston 56 as the drive element. The rotary engine of the present invention continues to operate in this manner with control mechanisms 72 and 74 operating to alternately couple their corresponding piston-forming pieces to the central shaft at regular and controlled intervals to prevent rearward movement of their corresponding piston-forming pieces at regular and controlled intervals and to restrict forward movement of their corresponding piston-forming pieces at regular and controlled intervals. In particular, latching mechanism 76 operates to prevent rearward movement of its associated piston-forming piece when one of the pistons carried by its associated piston-forming piece is to be used as the abutting piston of the combustion chamber. Latching mechanism 78, on the other hand, operates to restrict forward movement of its associated piston-forming piece just prior to ignition of the spark plug to ensure that one of the pistons carried by its associated piston-forming piece will be properly positioned to act as the drive piston during the power stroke. Latching mechanism 80 functions to transfer rotary motion from the fly wheel to its associated piston-forming piece during the latter part of every other power stroke. Finally, latching mechanism 82 is operable to transfer rotary motion from its associated piston-forming piece to the fly wheel when one of the pistons carried by this piece is acting as the drive piston.

From the foregoing, it will be seen that this invention is one well adapted to attain all of the ends and objects herein set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A rotary engine comprising:

a stationary housing presenting an interior chamber therein;

a shaft supported for rotation on said housing in extension through said chamber;

first and second coupling pieces sleeved on said shaft in said chamber, each coupling piece being rotatable relative to said shaft;

first and second hubs each having a pair of radial pistons thereon, said first and second hubs being sleeved on the respective first and second coupling pieces for rotation relative thereto with the pistons of said first and second hubs being alternately situated within said chamber to form four separate combustion chambers;

means for temporarily maintaining each hub against backward movement to permit one piston thereof to form a stationary abutment on one side of a firing chamber defined at a predetermined location within said interior chamber;

means for holding each hub against forward movement to maintain a drive piston thereof on the opposite side of said firing chamber as said one piston of the other hub approaches said drive piston to compress a fuel charge in said firing chamber, said holding means releasing the hub at a preselected rotative position of the shaft;

means for effecting combustion of the fuel charge in said firing chamber to effect a power stroke when said shaft reaches said preselected rotative position, said power stroke driving said drive piston away from the stationary abutment to rotate the hub of the drive piston;

means for translating rotation of said drive piston hub into rotation of said shaft during said power stroke; and a lost motion connection between said first coupling piece and said first hub and between said second coupling piece and said second hub to provide rotary movement of each coupling piece in unison with the associated hub for a major portion of each revolution and independently of the associated hub for the remainder of each revolution, each lost motion connection being arranged to permit the piston forming said stationary abutment during one power stroke to move relative to the associated coupling piece across said firing chamber to the opposite side thereof to act as the drive piston for the next power stroke.

2. An engine as set forth in claim 1, including means for mechanically coupling said shaft with the hub of the drive piston during the latter part of each power stroke.

3. An engine as set forth in claim 1, wherein each lost motion connection includes:

a key element projecting from each hub; and an opening in each coupling piece receiving the corresponding key element therein and defining an arc substantially equal to the arc defined between said stationary abutment and said drive piston at said preselected rotative position of the shaft.

4. A rotary engine comprising:

a stationary housing presenting an interior region therein;

a shaft supported for rotation on said housing in extension through said interior region thereof;

first and second cylindrical coupling pieces sleeved on said shaft in a manner to be capable of rotation independently thereof;

first and second hubs sleeved on the respective first and second coupling pieces, each hub having a pair of diametrically opposed pistons extending radially therefrom in an arrangement wherein the pistons of said first hub are alterately situated with the pistons of said second hub;

a firing chamber defined at a preselected location within said interior region of the housing;

an opening in each coupling piece;

a key element projecting from each hub into the corresponding opening and freely movable therein to provide movement of each hub in unison with the corresponding coupling piece for the majority of each revolution and independently of the corresponding coupling piece for the remainder of each revolution;

a first ratchet for each coupling piece carried thereon;

a first pawl on said housing engageable with said first ratchet to prevent backward movement of each hub when one piston thereof reaches one side of said firing chamber to provide a stationary abutment;

a second ratchet for each coupling piece carried thereon;

a second pawl on said housing engageable with said second ratchet to prevent forward movement of each hub when one piston thereof reaches the opposite side of said firing chamber to provide a drive piston;

cam means connected with said shaft for effecting release of said second pawl from said second ratchet when said shaft reaches a predetermined rotative position;

means for effecting combustion of a fuel charge compressed between said stationary abutment and drive piston when said shaft reaches said predetermined rotative position, thereby effecting a power stroke carrying said drive piston away from the stationary abutment;

a third ratchet for each coupling piece carried thereon; and a third pawl connected with said shaft for rotation therewith and engageable with said third ratchet during the power stroke to transmit rotational movement to the shaft from the hub which carries the drive piston.

5. An engine as set forth in claim 4, including:

a fourth ratchet for each coupling piece carried thereon;

a fourth pawl connected with said shaft for rotation therewith and engageable with said fourth ratchet during the latter part of the power stroke to mechanically couple the shaft with the hub carrying the drive piston to force the opposite piston toward the stationary abutment during compression of a fuel charge therebetween, the loose fit of said key element in said opening permitting the stationary abutment to traverse the firing chamber to act as the drive piston for the ensuing power stroke.

6. An engine as set forth in claim 5, including cam means for effecting release of said fourth pawl from said fourth ratchet when the hub reaches a position wherein said opposite piston is located on said one side of the firing chamber to form the stationary abutment for the ensuing power stroke.

* * * * *